US009039079B2

(12) United States Patent
Huntsberger et al.

(10) Patent No.: US 9,039,079 B2
(45) Date of Patent: May 26, 2015

(54) CHILDREN'S TRAY WITH PLACEMENT INDICATOR

(71) Applicant: Mattel, Inc., El Segundo, CA (US)

(72) Inventors: Kurt J. Huntsberger, Arcade, NY (US); Juliette Marlene Welch, East Aurora, NY (US); Maarten Van Huystee, Lancaster, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 13/859,928

(22) Filed: Apr. 10, 2013

(65) Prior Publication Data

US 2013/0285421 A1 Oct. 31, 2013

Related U.S. Application Data

(60) Provisional application No. 61/623,146, filed on Apr. 12, 2012.

(51) Int. Cl.

| | |
|---|---|
| ***A47B 39/00*** | (2006.01) |
| ***A47D 3/00*** | (2006.01) |
| ***A47D 1/00*** | (2006.01) |

(52) U.S. Cl.
CPC . *A47D 3/00* (2013.01); *A47D 1/008* (2013.01)

(58) Field of Classification Search
USPC ..... 108/25, 27; 297/153, 148; 206/561, 564
See application file for complete search history.

(56) References Cited

U.S. PATENT DOCUMENTS

| | | | | |
|---|---|---|---|---|
| 2,560,708 A | | 7/1951 | Titus | |
| 2,731,072 A | | 1/1956 | Post | |
| 3,909,061 A | | 9/1975 | Johnson | |
| 4,606,576 A | * | 8/1986 | Jones | 297/153 |
| 4,842,331 A | | 6/1989 | Waples | |
| 5,131,715 A | | 7/1992 | Balles | |
| 5,294,172 A | * | 3/1994 | Dubus | 297/148 |
| 5,458,394 A | * | 10/1995 | Nichols et al. | 297/173 |
| 5,531,502 A | | 7/1996 | Berggren | |
| 5,951,102 A | | 9/1999 | Poulson et al. | |
| 6,082,814 A | | 7/2000 | Celestina-Krevh et al. | |
| 6,089,654 A | | 7/2000 | Burstein | |
| 6,095,607 A | | 8/2000 | Wenzel | |
| 6,293,623 B1 | | 9/2001 | Kain et al. | |
| 6,416,124 B1 | * | 7/2002 | Chen et al. | 297/149 |

(Continued)

FOREIGN PATENT DOCUMENTS

FR 2919164 A1 1/2009

OTHER PUBLICATIONS

International Search Report for PCT/US2013/036079, dated Jul. 29, 2013.

*Primary Examiner* — Jose V Chen

(74) *Attorney, Agent, or Firm* — Edell, Shapiro & Finnan, LLC

(57) ABSTRACT

A children's tray with a placement indicator includes a tray and a groove/spot formed in the tray to indicate where an eating item (including food, utensils, or dishware) is to be placed. The tray can be mounted, removably or fixedly, to a variety of child support structures, including high chairs, booster seats and bouncers and includes a wall around the periphery intended to prevent items from falling off of the tray. The groove/spot formed in the tray may be formed from of a material having a higher coefficient of friction than the material used to form the tray. The groove/spot formed in the tray may be formed from of a material having a different color than the material used to form the tray.

18 Claims, 7 Drawing Sheets

(56) References Cited

U.S. PATENT DOCUMENTS

| | | | | |
|---|---|---|---|---|
| 6,497,452 | B2 * | 12/2002 | Catelli | 297/153 |
| 6,814,235 | B2 | 11/2004 | Wang | |
| 6,932,426 | B2 * | 8/2005 | Greger | 297/149 |
| 7,104,603 | B2 | 9/2006 | Keegan et al. | |
| 7,201,440 | B2 | 4/2007 | Heck et al. | |
| 7,328,951 | B2 | 2/2008 | Ward et al. | |
| 7,387,337 | B2 | 6/2008 | Keegan et al. | |
| 7,475,937 | B2 * | 1/2009 | McGrew et al. | 297/148 |
| 7,506,763 | B2 * | 3/2009 | Hatcher | 206/565 |
| 7,673,934 | B2 | 3/2010 | Bearup et al. | |
| 7,992,714 | B1 | 8/2011 | Devault et al. | |
| 8,162,390 | B2 * | 4/2012 | Zhong | 297/130 |
| 8,167,129 | B2 * | 5/2012 | Hatcher | 206/565 |
| 8,201,879 | B2 * | 6/2012 | Hartenstine et al. | 297/153 |
| 2002/0060480 | A1 | 5/2002 | Catelli | |
| 2004/0075308 | A1 | 4/2004 | Cutshall et al. | |
| 2005/0017549 | A1 * | 1/2005 | Chen | 297/16.1 |
| 2005/0126445 | A1 | 6/2005 | Guard et al. | |
| 2008/0149580 | A1 | 6/2008 | Hill | |
| 2008/0185898 | A1 | 8/2008 | Ward et al. | |
| 2009/0139890 | A1 | 6/2009 | Hatcher | |
| 2009/0315379 | A1 | 12/2009 | Jacobs et al. | |
| 2011/0181084 | A1 | 7/2011 | Arnold, IV et al. | |

* cited by examiner

CHILDREN'S TRAY WITH PLACEMENT INDICATOR

CROSS-REFERENCE TO RELATED APPLICATION

This application claims priority to and is based on U.S. Patent Application No. 61/623,146, filed Apr. 12, 2012, entitled "Children's Tray with Placement Indicator," the entire disclosure of which is incorporated by reference herein in its entirety.

FIELD OF THE INVENTION

The present invention relates to a tray for an infant support structure, such as a high chair or booster seat.

BACKGROUND OF THE INVENTION

Various children's trays for various child support structures are known. Some of these infant trays include slots, holes, or magnets configured to secure various dishes on the tray. However, in order to secure a dish in a slot or hole, the dish must be a certain size and in order to secure a dish with magnets, the dish must be specially configured to interact with the magnets. Further, many trays with polymer inserts, covers or inlays are known, but these children's trays include multiple parts which must each be washed separately. Thus, an easily cleaned children's tray with a placement indicator capable of receiving food items and/or various dishes is desirable.

SUMMARY OF THE INVENTION

According to one embodiment, a children's tray includes an upper surface and lower surface formed from a first material and a target area formed in the upper surface of the tray, and a second material forming the groove/spot and coupled to the tray. The groove/spot provides a placement indicator in the tray while the second material may: (1) have a coefficient of friction greater than the coefficient of friction of the first material; (2) be softer or more resilient than the first material; and/or (3) simply have a different color than the first material.

In another embodiment, the groove/spot is an annulus formed in a central portion of the upper surface. In still another embodiment, the tray is formed by co-molding the second material with the first material.

Another embodiment of the children's tray includes a tray having an upper surface and a lower surface formed from a first material and a groove/spot formed in the upper surface of the tray. The groove/spot is configured to receive a second material which provides a target area and may have a coefficient of friction greater than the coefficient of friction of the first material.

In some embodiments, the second material fills the groove/spot and is fixedly coupled within the groove/spot. In other embodiments, the second material is a different color from the first.

In still another embodiment, a children's tray includes a first material forming a tray with an upper surface and lower surface, a groove/spot formed in the upper surface of the tray, and a second material filling the groove/spot and coupled to the tray. The second material provides a target area and may have a coefficient of friction greater than the coefficient of friction of the first material.

In some of these embodiments, the second material is a low-density polyethylene and polypropylene blend. For example, the second material may be a thermoplastic elastomer, such as thermoplastic polyolefin elastomer.

In still further embodiments, the present invention is directed towards a child support structure including a seat having a front portion and a rear portion and a tray coupleable to the front portion of the seat. The tray includes an upper surface and a lower surface formed from a first material and a target area formed in the upper surface of the tray. The target area is formed from a second material, the second material having a higher coefficient of friction than the first material. The second material is also a different color from the first material such that the second material provides a placement indicator on the upper surface.

In some of these embodiments, the child support structure is a booster seat and in other embodiments, the child support structure is a high chair. Regardless, in some embodiments, the tray may be removably coupleable to the seat.

Additionally, in still other embodiments, the target area is a first target area and the tray also includes a plurality of target areas. Each target area is filled with the second material, such that the tray provides a plurality of placement indicators. In some of these embodiments, each placement indicator is a different color.

BRIEF DESCRIPTION OF THE DRAWINGS

Like reference numerals have been used to identify like elements throughout this disclosure.

DETAILED DESCRIPTION OF THE INVENTION

Referring generally to FIGS. 1-7B, a children's tray and a support structure, in accordance with the present invention, on which the children's tray may be mounted on is illustrated. The tray may be selectively mounted to various child supports, such as the high chair support structure depicted in FIGS. 1-5, and may help to secure a child within the support structure. In one exemplary embodiment, and as generally illustrated in FIGS. 1-7B, the children's tray may include a wall surrounding the periphery in order to prevent items stored thereon from falling off the tray. Additionally, the tray may include a placement indicator, such as a groove/spot, which may guide a child to place a plate or bowl in a certain location or to simply visually draw the child's attention to a portion of the tray where food, a utensil, or a food container is place. The groove/spot may also serve to secure any suitable items placed thereon in place.

Figure 1:
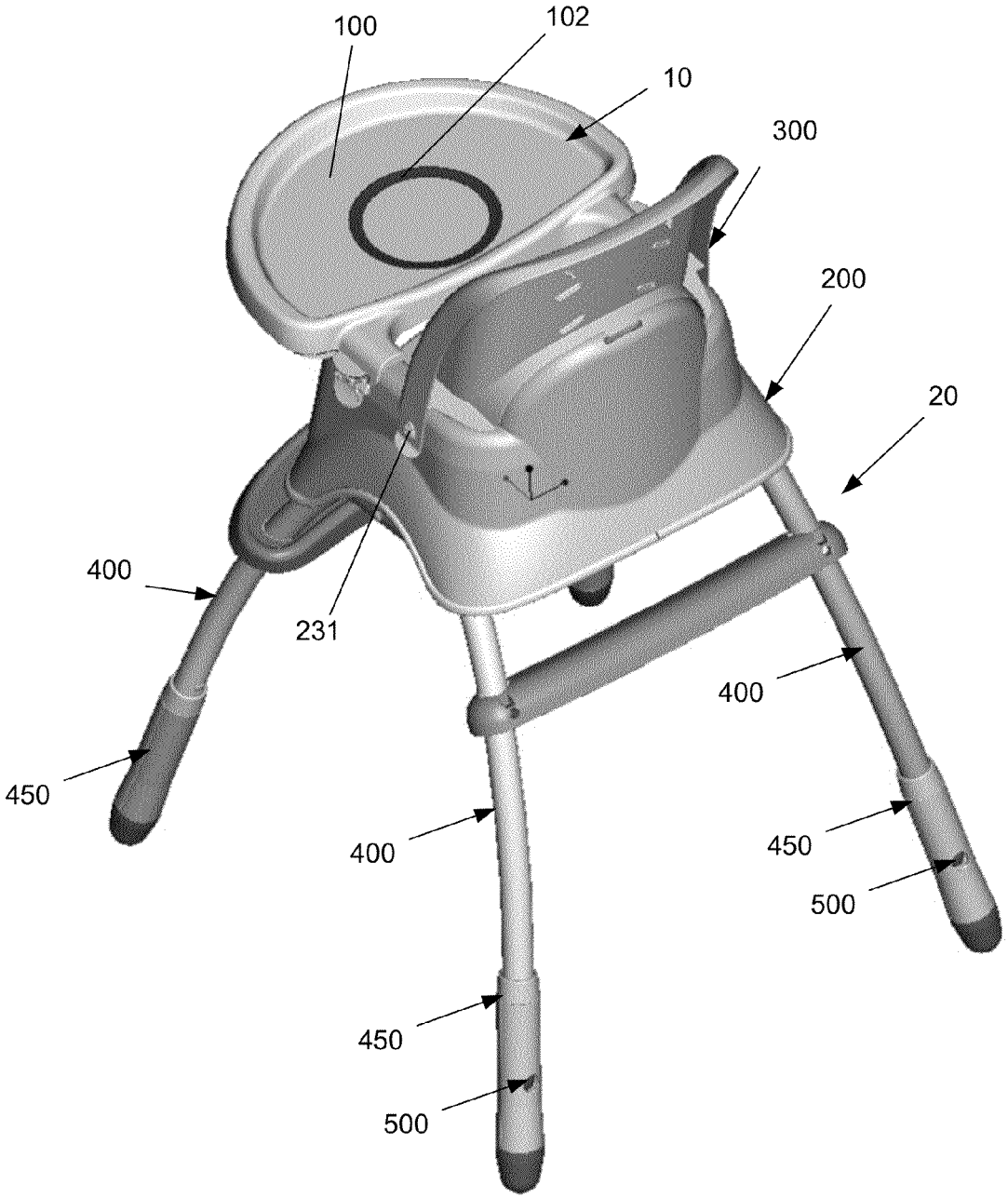
FIG. 1 illustrates an elevated rear perspective view of a children's tray according to an embodiment of the present invention mounted to a child support structure.

Referring to FIG. 1, in one exemplary embodiment, a children's tray 10 may be mounted to a child support structure 20. The support structure may include a seat 200, a backrest 300, and legs 400. Feet 450 may be included at the distal end of each of the legs 400, and the feet 450 may include an adjustment mechanism 500. The tray 10 is shown coupled to a highchair, but in other embodiments, tray 10 may be coupled, either fixedly or removably, to any desirable support structure. More specifically, in the exemplary embodiment depicted in FIG. 1, tray 10 is removably coupled to the support structure 20. The tray 10 may be either be coupled around a child seated in seat 200 or coupled to the support before a child is placed in seat 200. Regardless, tray 10 includes a top surface 100 with a groove/spot 102 which may indicate where a dish or food should be placed on tray 10. Groove/spot 102 will be discussed in further detail below.

Figure 2:
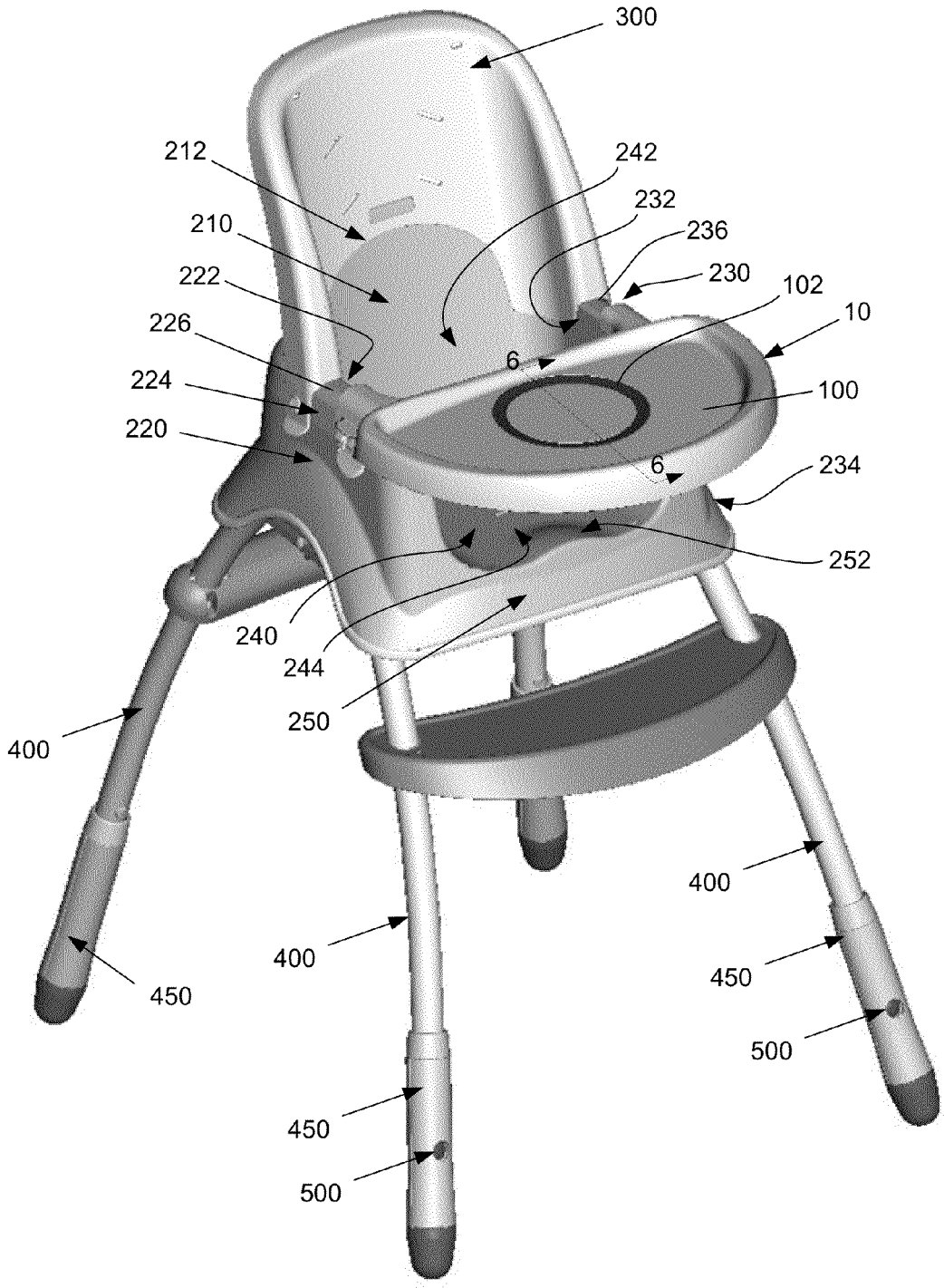
FIG. 2 illustrates an elevated front perspective view of the children's tray and support structure of FIG. 1.

Now referring to FIG. 2, FIG. 2 illustrates a front perspective of the support structure 20 of FIG. 1. The seat 200 may include a rear portion 210 and a bottom portion 250. The rear and bottom portions 210 and 250 may be bound on either side by a first side 220 and a second side 230. Together with first side 220 and second side 230, bottom portion 250 and back portion 210 may form a child receiving portion or interior cavity 240. The interior cavity 240 may include front opening 244 and top opening 242, such that the legs of a child seated in cavity 240 may extend through front opening 244 while the torso of the child extends through top opening 242.

In some embodiments seat 200 may be formed from multiple sections or pieces which may be coupled together in any suitable manner. However, in other embodiments, all of the components, sections, and sides of seat 200 may be formed integrally in any suitable manner, including via molding. Thus, for example, the sides of seat 200 may not be single sides or walls, but may include an inner surface or wall, an outer surface or wall, a top edge, and a hollow or open area therebetween. In the exemplary embodiment depicted in FIG. 2, first side 220 includes an inner wall 222 and an outer wall 224 which are connected at a top edge 226, while second side 230 includes an inner wall 232 and an outer wall 234 which are connected at a top edge 236. In contrast, rear portion 210 may be a single wall or side including a top edge 212.

Still referring to FIG. 2, any of the surfaces which form part of cavity 240 (i.e. the top surface of bottom portion 250 and the interior surfaces of first side 220, second side 230, and rear portion 210) may be contoured in any desirable manner to increase the comfort or functionality of seat 200. For example, in the embodiment depicted in FIG. 2, bottom portion 250 includes a top surface 252 with a generally "W"-shaped contour, such that top surface 252 forms two leg portion configured to comfortably receiving the legs of a child.

Figure 3:
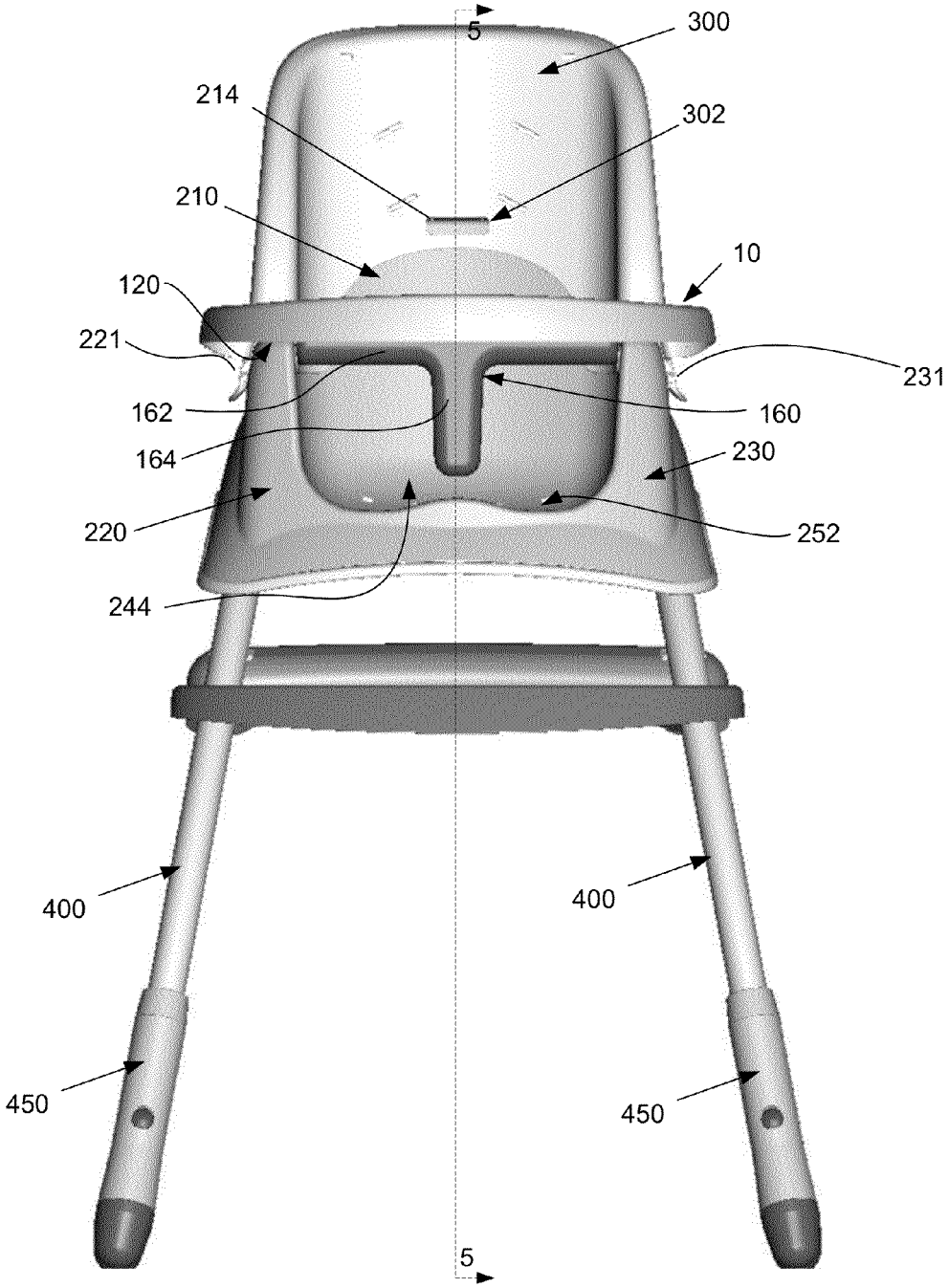
FIG. 3 illustrates a front perspective view of the children's tray and support structure of FIG. 1.

Now referring to FIGS. 2 and 3, the support structure 20 and tray 10 may include additional features, such as a removable backrest 300 and crotch restraint 160, respectively, in order to ensure that a child is comfortably secured within seat 200. Backrest 300 may substantially align with rear portion 210, such that backrest 300 is essentially configured as an extension of rear portion 210. In this manner, backrest 300 may sit atop of the top edge 212 of rear portion 210 and be removably (or permanently) secured to seat 200 in this position. For example, in the embodiment of FIG. 3, rear portion 210 includes a projection 214 which may be securably received in an aperture 302 of backrest 300. Aperture 302 and projection 214 may be sized such that projection 214 is received in a friction or press fit to form a "child-resistant" joint which does not protrude into the child receiving portion 240 of seat 200. Additionally or alternatively, backrest 300 may be secured (fixedly or rotatably) to first and second sides 220 and 230 via protrusions 221,231.

Referring to FIG. 3, tray 100 may include a crotch restraint member 160 which may further ensure that a child is secured within a support structure 20. In the exemplary embodiment of FIG. 3, crotch restraint member 160 includes a base 162 and a projection 164 extending from the central portion of the base 162. Base 162 may substantially extend between first side 220 and second 230 such that base 162 may substantially span the width of interior cavity 240. Projection 164 may be formed integrally with base 162, which may, in turn, be coupled to a bottom surface 120 of tray 100. When coupled to bottom surface 120, crotch restraint member 160 may be configured such that projection 164 extends between a child's legs, forming two leg holes in the front opening 244 of interior cavity 240.

Figure 4:
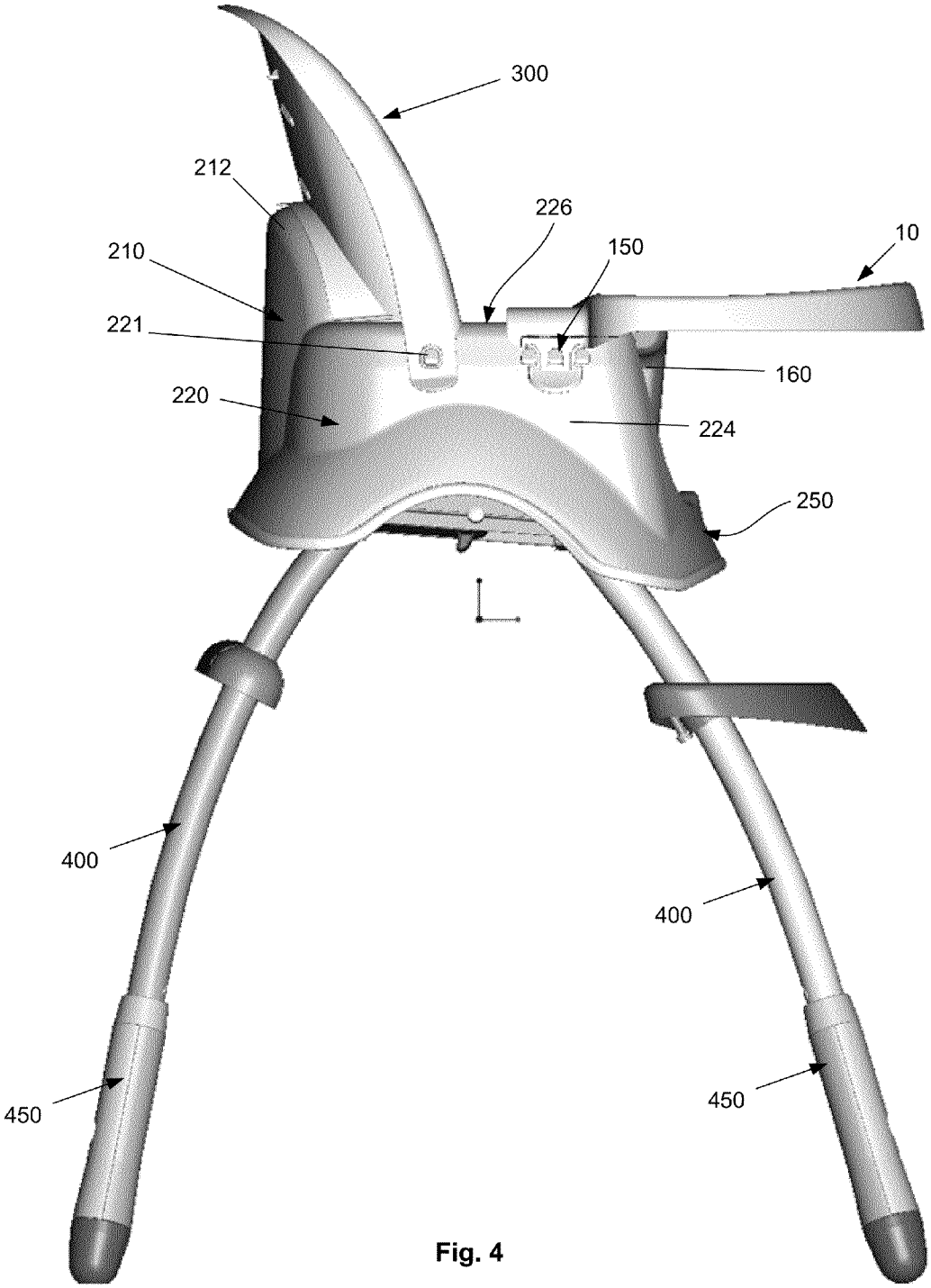
FIG. 4 illustrates a side perspective view of the children's tray and support structure of FIG. 1.

Now referring to FIG. 4, as discussed, backrest 300 and tray 10 may be removably or fixedly coupled to seat 200. For example, both backrest 300 and tray 10 may include joints or locking mechanisms, such as protrusions 221,231 and attachment mechanisms 150 to removably couple backrest 300 and/or tray 10 to seat 200. In the embodiment depicted by FIG. 4, tray 10 is removably coupled to seat 200 via locking mechanism 150 which is secured around the top edges 226 and 236 (see FIG. 2) of sides 220 and 230. Once mechanism 150 is secured around edge 226, it may be released, clamping onto the inner and outer walls 222 and 224, respectively, of first side 220 and the inner and outer walls 232 and 234, respectively, of second side 230 (see FIG. 2) in order to secure tray 10 in place. The backrest 300 may engage each of the side walls 220 and 230 in substantially the same manner about protrusions 221,231. Alternatively or additionally, backrest 300 and tray 110 may be secured to sides 220 and 230 in any suitable manner.

Figure 5:
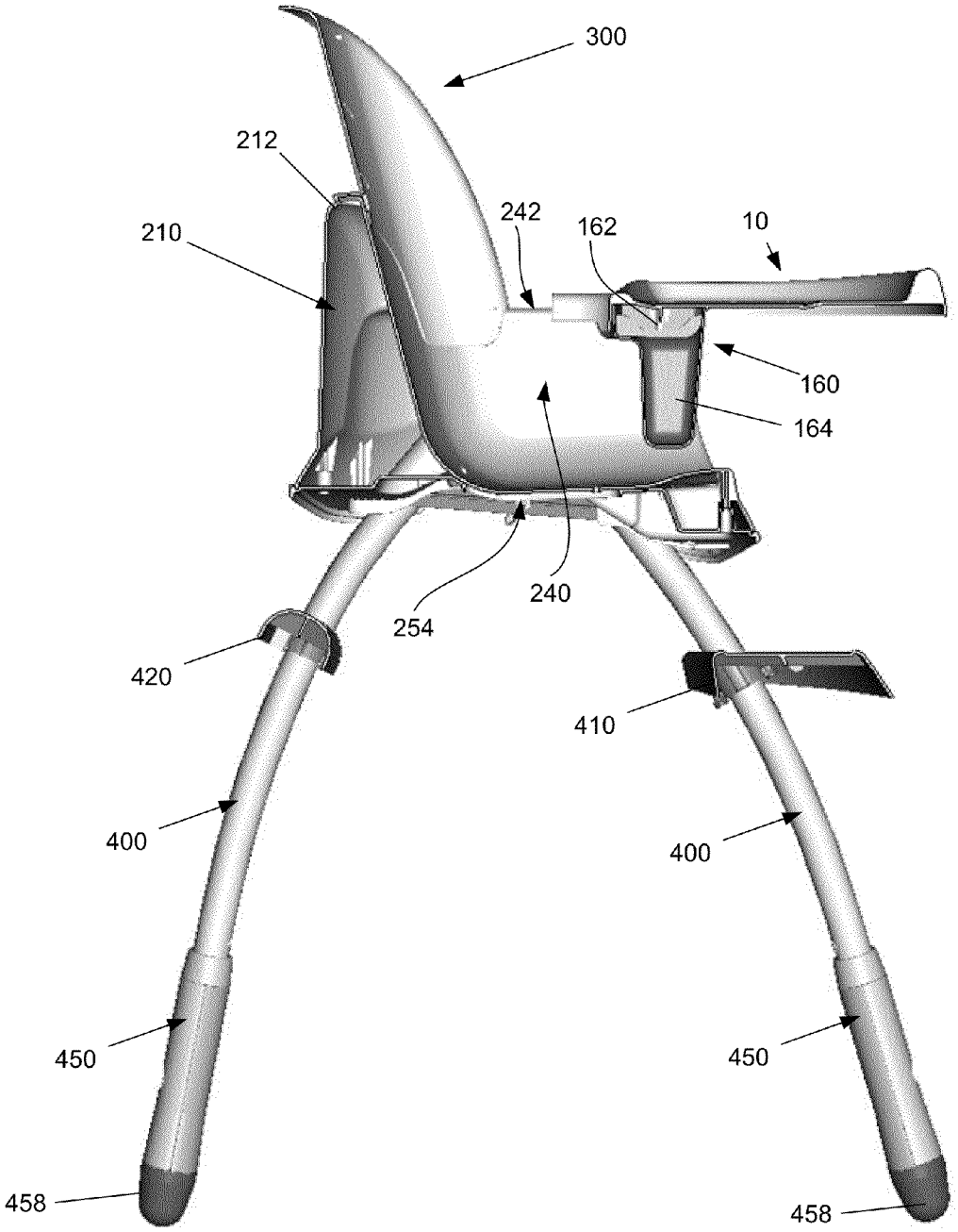
FIG. 5 illustrates a cross-sectional view of FIG. 4 (taken along line 5-5 of FIG. 3).

Now referring to FIG. 5, a cross-sectional view of the tray 10 and support structure 20 along line 5-5 of FIG. 3 is illustrated. This cross-sectional view illustrates the integration of tray 10, crotch restraint member 160 and support structure 20. Notably, crotch restraint member 160 substantially bisects interior cavity 240 when tray 10 is coupled to support structure 20 atop of first and second side 220 and 230. Additionally, when tray 10 is coupled to support structure, there is still enough room for a child's torso to fit comfortably in top opening 242, between backrest 300 and the tray 10.

Still referring to FIG. 5, legs 400 may be coupled to seat 200 at a lower surface 254 of bottom portion 250. In some embodiments, each of the legs 400 may be a separate and distinct piece which individually engages the lower surface 254 of bottom portion 250. For example, each of the legs 400 may be inserted into cylindrical bosses (not pictured) included in lower surface 254. In other embodiments, legs 400 may be formed from two "U"-shaped projections. Regardless of the shape or configuration of legs 400, lower surface 254 may be configured to receive and secure any desirable number of legs 400 in any desirable configuration. Additionally, in order to provide additional support, legs 400 may include covers 458 and support members, such as support members 410 and 420, to secure various legs 400 together. For example, in the exemplary embodiment depicted in FIG. 5, the distal end of each of the legs 400 includes a rubberized cover 458 to reduce that chance of slipping. Additionally, support member 410 is included to secure the two front legs 400 together (and provide a footrest) and support member 420 is included to secure the two rear legs 400 together. Support members 410 and 420, in conjunction with covers 458, may prevent or otherwise inhibit legs 400 from splaying or slipping laterally.

Figure 6A:
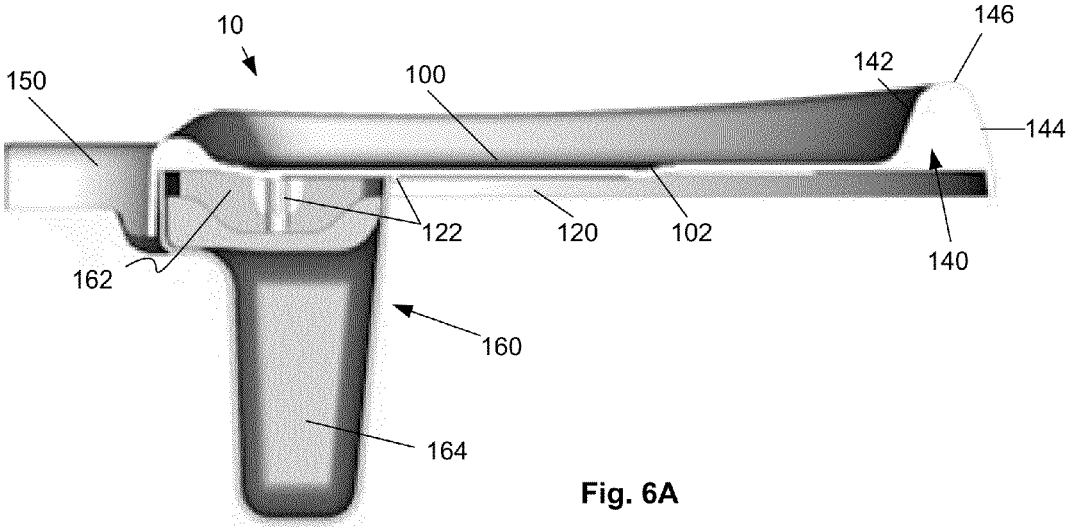
FIGS. 6A and 6B illustrate two perspective, cross-sectional views of the children's tray of FIG. 1 (taken along line 6-6 of FIG. 2).
Figure 6B:
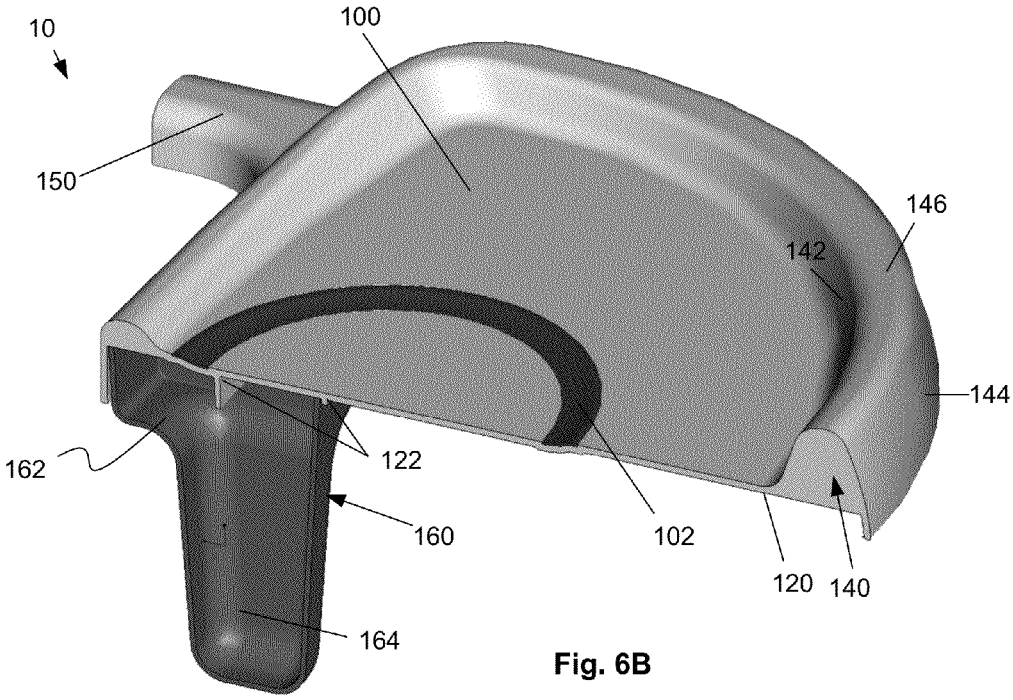

Now referring to FIGS. 6A-B, a cross-sectional view of tray 10 along sectional line 6-6 of FIG. 2 is shown from two different perspectives. Referring first to FIG. 6A, tray includes an upper surface 100, a lower surface 120, and an outer wall 140. Outer wall 140 may extend substantially around the periphery of tray 10, and may include an outer surface 144, an inner surface 142 and a top edge 146. The inner surface 142 may form a raised wall around the edges of tray 10 which may prevent objects stored or placed on the upper surface 100 of tray 10 from falling off of tray 10. Additionally, outer wall 140 or a portion thereof, such as outer surface 144, may also extend beyond lower surface 120 of tray 10, such that wall 140 may form a raised wall around the periphery of both of the upper and lower surfaces 100 and 120. Tray 10 may also include projections 122 extending from the interior of lower surface 120. For example, two projections 122 may extend downwards from surface 120 in order to engage and secure the base 162 of crotch restraint member 160.

Now referring to FIG. 6B, the top surface 100 of tray 10 may include a groove/spot 102 formed thereon. Groove/spot 102 may be formed in top surface 100 and may extend substantially into top surface 100, even extending entirely through tray 10 in some embodiments. Additionally, groove/spot 102 may be formed in any desirable shape in any desirable location on tray 10. Preferably, groove/spot 102 is formed on or in top surface 100 and does not extend through lower surface 120. In the exemplary embodiment depicted in FIG. 6B, groove/spot 102 is formed as an annulus located substantially in the center of tray 10 and does not extend through lower surface 120.

Groove/spot 102 may include or be configured to receive or be formed from any suitable material. For example, in some embodiments, groove/spot 102 may be a rubber-type of material that is co-molded with a plastic tray 10, such that groove/spot 102 is not actually a depression, but instead, groove/spot 102 is merely a portion of tray 102 formed from different or different color material. In some embodiments, groove/spot 102 may be a portion of the tray which is formed from any suitable material, such as soft polymers, which may have a higher coefficient of friction than the material used to fabricate the tray 10. Thus, groove/spot 102 may increase the friction forces between tray 10 and a dish placed thereon. In one particular embodiment, the tray 10 is formed from polypropylene and the groove/spot 102 is formed from KRATON thermoplastic elastomer (TPE). However, in other embodiments, groove/spot 102 is formed from a low-density polyethylene (LDPE) and polypropylene (PP) blend, such as VERSIFY™ 4301, a thermoplastic polyolefin elastomer from the Dow Chemical Co.

In other embodiments, groove/spot 102 may be a depression capable of receiving an insert of any suitable material, such as an insert formed from the aforementioned exemplary materials which may be used to form groove/spot 102. Regardless, the material will be such that it may help to resist movement of a plate, bowl, cup, or any other dish, dishware, or cutlery item by increasing the friction between the tray 10 and the bottom of the item and/or the material may be used to visually indicate or draw the attention of the seated child to items or food placed thereon (or within the "target area").

The second material included in or placed in groove/spot 102 serves as a target for a child. The groove/spot 102 may be located in any position which would be desirable to place a dish, food, or cutlery item. For example, when groove/spot 102 is included in the center of tray 10, it may serve as a target or placement indicator for a dish, food, or cutlery item. Using two different materials to form the tray 10 and the groove/spot 102 may be sufficient to provide a target or placement indicator, but this difference may be reinforced by including a second material which is colored or patterned differently from the first material used to form the tray 10. For example, tray 10 may be white plastic and groove/spot 102 may be blue rubber material which is co-molded onto tray 10. Alternatively, the groove/spot 102 may also just be a different color plastic.

Figure 7A:
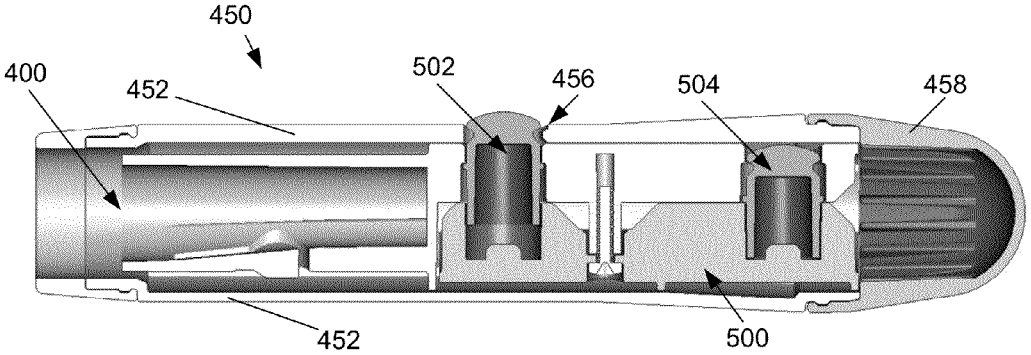
FIGS. 7A and 7B illustrate sectional views of the feet of the child support structure of FIG. 1.
Figure 7B:
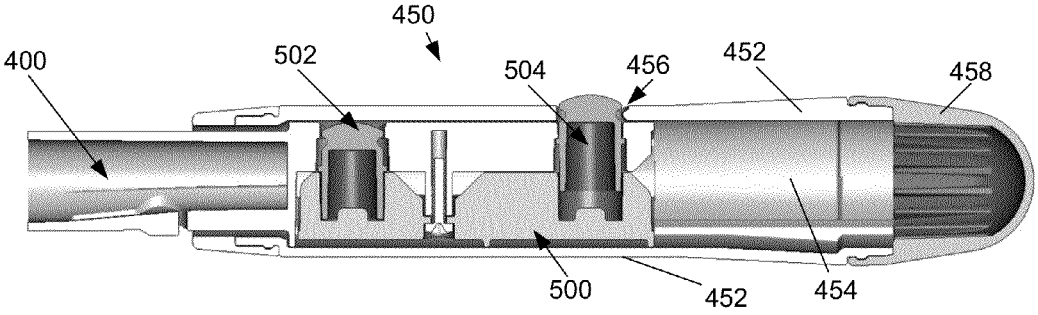

Now referring to FIGS. 7A and 7B, an exemplary embodiment of one of feet 450 is shown. Feet 450 may include an outer wall 452 which substantially surrounds an interior cavity 454 except for an aperture 456 extending from the interior cavity to a position exterior of outer wall 452 and an opening in the top (seen at the left of FIGS. 7A and 7B) to receive one of legs 400. An adjustment mechanism 500 may be housed substantially within interior cavity 454 and may allow support structure 20 to be adjusted to various heights.

Referring specifically to FIG. 7A, adjustment mechanism 500 is shown via a sectional view and one of the legs 400 is shown in a lowered position. Adjustment mechanism 500 may include two movable projections, projections 502 and 504. When in a lowered position, projection 502 is disposed within and extending through aperture 456 and projection 504 is disposed proximate the distal end of one of the feet 450 (i.e. proximate cover 458).

In contrast, FIG. 7B depicts one of the legs 400 in a raised position. When in a raised position, projection 504 is disposed within and extending through aperture 456. Thus, projection 502 is disposed proximate the open end of one of the feet 450. This configuration leaves a substantial gap between the adjustment mechanism 500 and the distal end of one of the feet 450. This gap in cavity 454 represent the height which the support structure has been raised from its lowered position to its raised position.

Each of the projections 502 and 504 may be spring biased such that the natural position of each projection 502 and 504 is extending beyond aperture 456. Thus, in order to move a leg 400 from a lowered position to a raised position, a user must depress projection 502 while pulling the respective leg 400 upwards until projection 504 aligns and subsequently extends through aperture 456, preventing further upwards movement of the leg 400. In order to reverse this operation and lower support structure 20, a user once again depresses the protruding projection, in this case projection 504, but pushes one of the legs 400 into its respective foot 450 until projection 502 becomes aligned with aperture 456. Once aligned, the spring bias of projection 502 may cause projection to extend through aperture 456, securing the leg 400 in place. If the support structure is in a vertical orientation, the user may not be required to push leg 400 downwards when lowering the support structure as gravity may serve this purpose.

In the exemplary embodiment depicted in FIGS. 7A and 7B, mechanism 500 allows support structure 20 to be disposed at two different heights. However, each of the legs 400 may include an adjustment mechanisms 500, and thus, in order to adjust support structure 20, each of legs 400 may have to be adjusted individually. Thus, support structure 20 may, at some moments, be slanted with respect to the horizontal axis. Preferably, a child will only be placed in the seat when the seat is in a substantially horizontal configuration, and thus, support structure 20 is considered to have two configurations: (1) when all of the legs 400 are in a raised configuration (i.e. projection 504 is extending through aperture 456 in each of the legs 400); and (2) when all of the legs 400 are in a lowered position (i.e. projection 502 is extending through aperture 456 in each of the legs 400).

It is noted that support structure 20, tray 10, or some combination thereof, can have any other suitable configuration as an alternative to the configuration described above and shown in the drawings. For example, with the tray 10 and backrest 300 removed from the support structure 20, the support structure 20 serves as an elevated toddler feeding seat (as opposed to a high chair). Additionally, the tray 10 of the present invention could also be utilized on a different support structure, such a as a booster sear, car seat, rocker, bassinet, swing, bouncer or any other children's support structure. Further, tray 10 may be of any shape or size and may or may not include an exterior wall. The indicator or groove/spot of tray 10 may also be of any size or shape, but is preferably sized to identify a location for a dish, food, utensils, or dishware and secure the dish or dishware in that location.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A children's tray, comprising:

a first material forming a tray with an upper surface and lower surface; and a target area formed in the upper surface of the tray, wherein the target area provides a placement indicator in the tray, the target area is formed from a second material having a coefficient of friction greater than the coefficient of friction of the first material, the target area is formed without providing gaps between the tray and the target area, and the target area is annular, such that the first material of the tray is disposed interiorly and exteriorly of the target area.

2. A method of manufacturing the children's tray of claim 1, comprising:

co-molding the second material with the first material.

3. The children's tray of claim 1, further comprising:

an outer wall formed around the periphery of the tray.

4. The children's tray of claim 3, wherein the outer wall is formed from the first material.

5. The children's tray of claim 1, wherein the second material has a different color than the first material to provide the placement indicator.

6. The children's tray of claim 5, wherein the second material is a low-density polyethylene and polypropylene blend.

7. The children's tray of claim 6, wherein the second material is thermoplastic polyolefin elastomer.

8. A children's tray, comprising:

a tray formed from a first material, the tray having an upper surface and a lower surface;

a placement indicator formed from a second material having a coefficient of friction greater than the coefficient of friction of the first material; and an annular groove formed in the upper surface of the tray configured to receive the placement indicator, wherein the placement indicator is positioned within the groove so that the second material fills the entire groove and eliminates gaps between the tray and the placement indicator.

9. The children's tray of claim 8, wherein the second material is a different color from the first material to provide the placement indicator.

10. The children's tray of claim 8, wherein the placement indicator is circular.

11. The children's tray of claim 8, wherein the placement indicator is a thermoplastic elastomer.

12. A child support structure comprising:

a seat having a front portion and a rear portion; and a tray coupleable to the front portion of the seat, the tray comprising:

an upper surface and a lower surface formed from a first material; and an annular target area formed in the upper surface of the tray such that there are no gaps between the target area and upper surface, the target area being formed from a second material and the second material having a higher coefficient of friction than the first material, wherein the second material is a different color from the first material such that the second material provides a placement indicator on the upper surface.

13. The child support structure of claim 12, wherein the child support structure is a booster seat.

14. The child support structure of claim 12, wherein the child support structure is a high chair.

15. The child support structure of claim 12, wherein the tray is removably coupleable to the seat.

16. The child support structure of claim 12, wherein the target area is a first target area and the tray further comprises:

a plurality of target areas, each target area being filled with the second material, such that the tray provides a plurality of placement indicators.

17. The child support structure of claim 16, wherein each placement indicator is a different color.

18. The child support structure of claim 12, wherein the second material is a thermoplastic elastomer.

* * * * *